United States Patent [19]

Scheunemann

[11] Patent Number: 4,921,027

[45] Date of Patent: May 1, 1990

[54] BILLFOLD AND MULTI-POCKET LINER THEREFOR

[75] Inventor: Roy Scheunemann, West Bend, Wis.

[73] Assignee: Amity Leather Products Company, West Bend, Wis.

[21] Appl. No.: 308,204

[22] Filed: Feb. 8, 1989

[51] Int. Cl.[5] ..... A45C 1/06; A45C 11/18

[52] U.S. Cl. ..... 150/147; 150/146; 206/39; 206/425; 40/124.2; 40/124.4

[58] Field of Search ..... 150/147–149, 150/131, 132, 143; 40/124.2, 124.4, 124; 206/425, 39 R; 229/71, 72

[56] References Cited

U.S. PATENT DOCUMENTS

| | | | |
|---|---|---|---|
| 737,232 | 8/1903 | Heeley et al. | 206/425 |
| 1,896,573 | 2/1933 | Buxton | 206/425 X |
| 1,909,807 | 5/1933 | Buxton | 206/450 X |
| 2,665,808 | 1/1954 | McAlister | 206/425 |
| 2,959,879 | 11/1960 | Mazur | 40/150 X |
| 3,067,792 | 12/1962 | Broughton | 150/147 |
| 3,146,816 | 9/1964 | Osher | 150/148 |
| 3,280,820 | 10/1966 | Miller | 40/124.2 |
| 3,392,771 | 7/1968 | Hartley | 150/147 |
| 3,659,640 | 5/1972 | Fenster et al. | 150/147 |
| 3,777,795 | 12/1973 | Graetz | 150/147 |
| 3,856,063 | 12/1974 | Dengel | 150/147 X |
| 3,959,904 | 6/1976 | Holliday | 40/124.2 X |
| 4,589,544 | 5/1986 | Schweinsberg | 206/425 X |

*Primary Examiner*—Sue A. Weaver
*Attorney, Agent, or Firm*—Fitch, Even, Tabin & Flannery

[57] ABSTRACT

The present invention provides a billfold, wallet, or the like for carrying a plurality of cards, such as credit cards, in shingled and partially exposed relationship to one another whereby a desired card can be readily selected and withdrawn.

The billfold has a pair of flexible walls which are sewn together to form an envelope-like opening. One of the walls has affixed thereto a multi-card liner. The liner includes a support member which has at least two vertical slits extending from a bottom edge to provide a downwardly extending tongue member. A plurality of card-receiving leaves is then provided. Each of the leaves has a tongue-receiving slit extending in a horizontal direction. The leaves are strung along the tongue of the support member in a vertically aligned, partially overlapping array to form the integral liner of the invention having a series of single edge overlying cavities arranged in shingled relationship for the reception of cards. At least one of the multi-card liners is affixed to one of the flexible walls of the billfold to provide a billfold structure having an envelope-like opening, one side of which has a series of card receiving cavities arranged in shingled relationship for the reception of cards.

10 Claims, 2 Drawing Sheets

FIG. 1
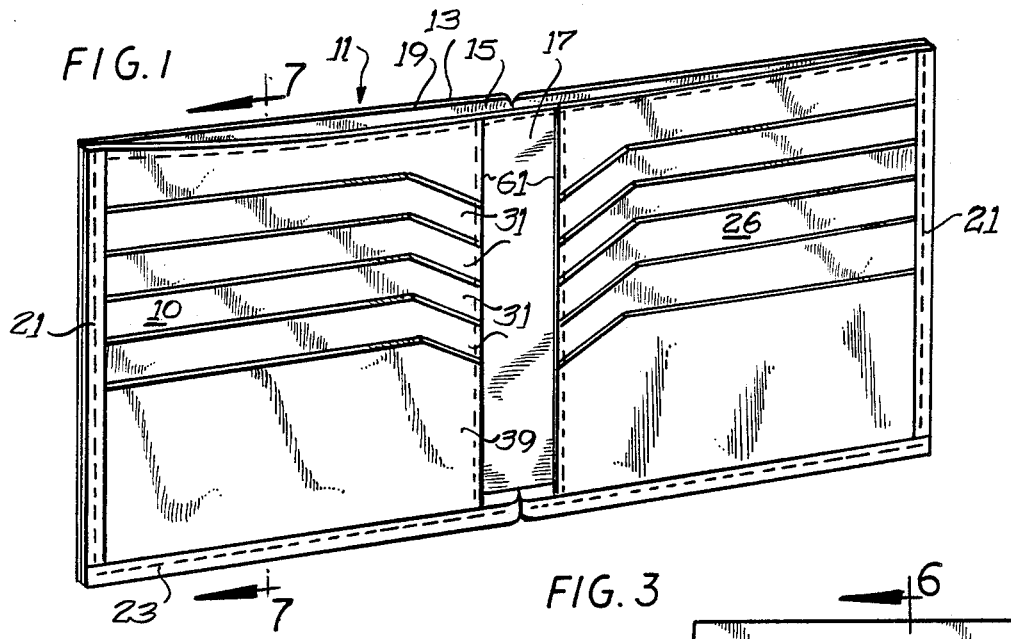
FIG. 3
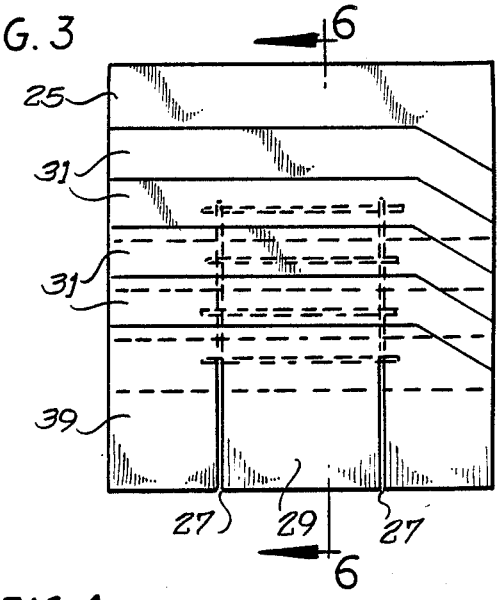
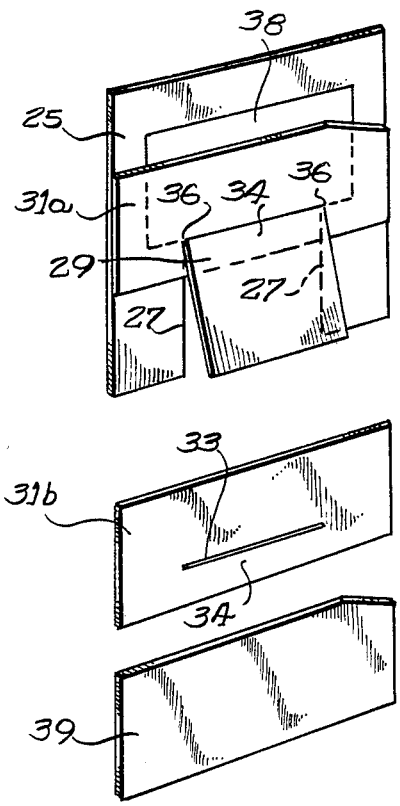
FIG. 2
FIG. 4
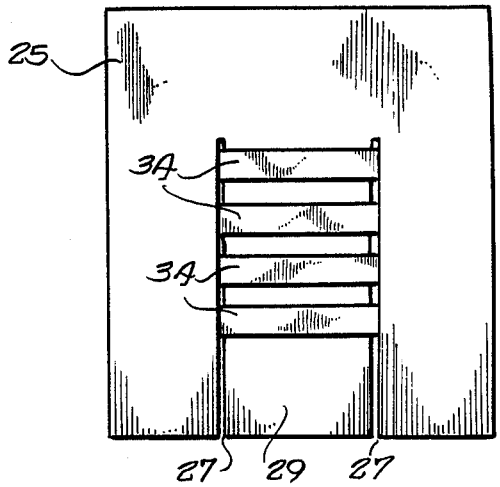

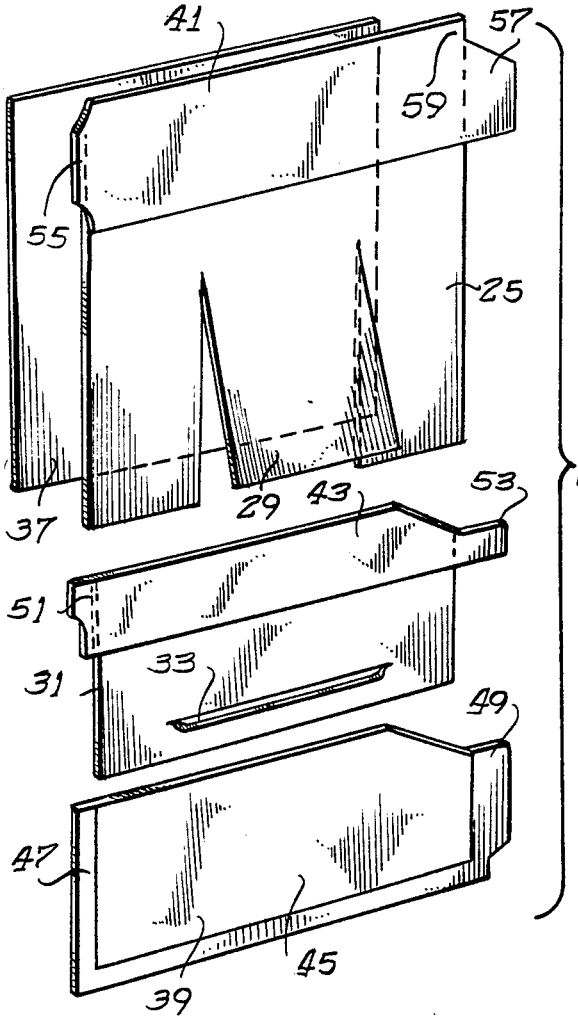
FIG.5
FIG.7
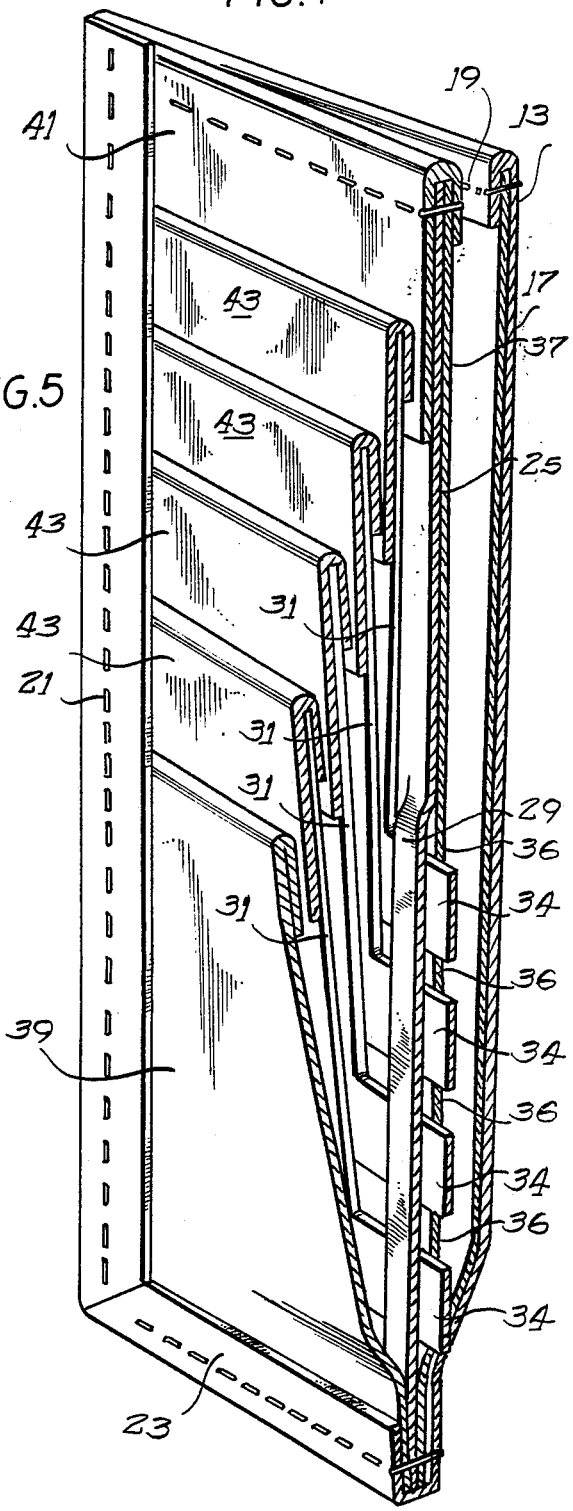
FIG.6
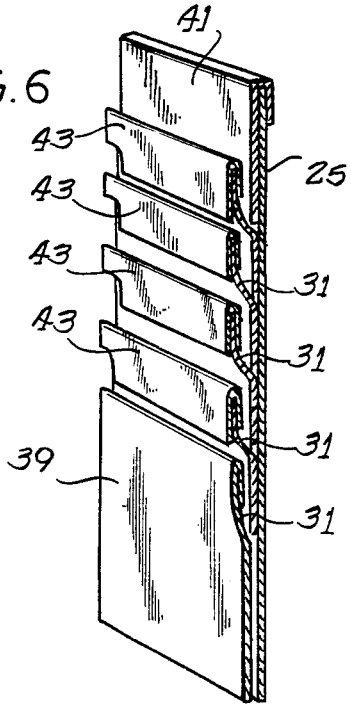

BILLFOLD AND MULTI-POCKET LINER THEREFOR

FIELD OF THE INVENTION

The present invention relates to multiple card wallets or billfolds wherein the cards are held in overlapping, shingled relationship so as to be easily accessible for selective withdrawal of a card. More particularly, the present invention is directed to a liner for use in the manufacture of a billfold to provide a multi-card billfold for holding cards in overlapping, shingled relationship.

BACKGROUND AND PRIOR ART

Multiple card wallets or billfolds are known wherein the cards are held in overlapping, shingled relationship. Such prior art multiple card billfolds have usually been constructed so as to provide integral pockets for receiving the credit card. Such prior art multi-card billfolds were very time consuming to assemble and secure together. For example, one prior art type of multi-card billfold utilized separate pockets wherein the pockets were individually assembled in respect to one another and were then hand glued or pasted.

One improved form of multi-card billfold is disclosed in U.S. Pat. No. 3,856,063 to Dengel. In the Dengel Patent, a liner for use in assembling a multi-pocket billfold is described. The liner comprises a plastic backing sheet which can be heat-sealed. Pockets are formed in the liner through use of a series of overlying plastic members which are tacked or heat-sealed at appropriate places to provide pockets for receiving cards. The Dengel Patent solved many problems in respect to ease of assembly of multi-card billfolds, however, it would be desirable to further reduce the amount of material and labor required to manufacture multi-card billfolds. Accordingly, it is a principal object of the the present invention to provide a billfold which utilizes a multi-card liner which is easy to assemble and which reduces the amount of materials and the amount of time required to affect such assembly.

SUMMARY

The present invention provides a billfold, wallet, or the like for carrying a plurality of cards, such as credit cards, in shingled and partially exposed relationship to one another whereby a desired card can be readily selected and withdrawn.

More particularly, the present invention provides a billfold of the above type which has a pair of flexible walls which are sewn together to form an envelope-like opening. One of the walls has affixed thereto a multi-card liner. The liner includes a support member which has at least two vertical slits extending from a bottom edge to provide a downwardly extending tongue member. A plurality of card-receiving leaves is then provided. Each of the leaves has a tongue-receiving slit extending in a horizontal direction. The leaves are strung along the tongue of the support member in a vertically aligned, partially overlapping array to form the integral liner of the invention having a series of single edge overlying cavities arranged in shingle relationship for the reception of cards. At least one of the multi-card liners of the invention is affixed to one of the flexible walls of the billfold to provide a billfold structure having an envelope-like opening, one side of which has a series of card receiving cavities arranged in shingled relationship for the reception of cards.

These and other objects and advantages of the present invention will become more apparent from the following detailed disclosure and the accompanying drawings.

BRIEF DESCRIPTION OF THE DRAWINGS

FIG. 1 is a perspective view of a billfold embodying the present invention, the view being taken generally from the inside of the billfold;

FIG. 2 shows a partially assembled and a partially exploded view of the liner of the invention;

FIG. 3 is a front view of a partially assembled liner made in accordance with the invention;

FIG. 4 is a back view of FIG. 3; and

FIG. 5 is a further embodiment of the liner shown in FIG. 2 showing various additional features;

FIG. 6 is a sectional view taken generally along line 6—6 of FIG. 3.

FIG. 7 is a sectional view taken generally along line 7—7 in FIG. 1, but on an enlarged scale and being somewhat exaggerated in that the individual leaves are pulled outwardly to show the construction.

DETAILED DESCRIPTION

The invention is shown in FIG. 1 as embodied in a billfold 11 which is made generally from a flexible material, for example, leather. The billfold 11 includes an outside flexible wall 13 lined with fabric 15 and an inner flexible wall 17, which may be formed of fabric. The usual edging and stitching is provided around the periphery to bind the billfold together. More specifically, the edging and stitching binds the outside flexible wall 13 and its fabric liner 15 together and also binds together the two flexible walls 13 and 17.

The flexible walls 13 and 17 are secured together by the binding around the vertical sides 21 and the lower side 23, thus presenting an envelope-like opening between the flexible walls 13 and 17.

The inner flexible wall 17 has a series of cavities provided on the surface thereof by the liner 10 of the invention for receiving credit cards in a manner so that a portion of the credit card extends therefrom and can readily be found when in overlapping and shingled relationship with one another. The series of cavities is provided by a liner whose construction is best seen in FIG. 2.

As shown in FIG. 2, a support member 25 is provided. The support member 25 is made from any suitable material, such as urethane. The support member may have a backing sheet, not shown, made from paper or other suitable material, to provide further stiffness to the support member. The support member 25 has at least one pair of vertical slits 27 which extend from the lower edge of the support member so as to form a downwardly, extending tongue member 29 integrally joined to the upper portion of the support member. As used herein, the terms "front", "back", "bottom", "top", "side", "horizontal", and "vertical" refer to relative positions for a billfold which is oriented as shown in FIG. 1.

A plurality of leaves 31 is then provided which coact with the support member to provide the liner of the invention having a series of single edge overlying cavities arranged in shingled relationship for the reception of cards. Each of the leaves 31 has a tongue-receiving slit 33 extending horizontally thereacross. The slit 33 is positioned so that when the tongue is passed downwardly behind the leaf 31 through the slit and over the front of the leaf 31, the leaf 31 may be moved upwardly along the length of the tongue member to position the leaf axially aligned in partially overlapping position on the face of the support member 25. As shown in FIG. 2, one leaf 31*a* has been placed into position while a second leaf 31*b* is shown in a position ready for insertion onto tongue 29. The strip of material 34 on the leaf 31 lying beneath slot 33 passes behind tongue 29. When in final position, the junction of the top of strip 34 with slit 27 provides a card carrying restraining edge 36 for a card 38. The number of leaves usually employed will be from 3 to 6.

After the final leaf has been placed in partially overlying relationship to the penitently leaf, a bottom plate 39 is placed in partially overlying relationship over the last leaf to form the bottom most cavity, which is in reality a true pocket. The bottom plate has a shape generally conforming to that of a leaf. A plurality of leaves 31 and the bottom plate 39 after being placed into position can be affixed to the support member 25 by suitable means, such as by gluing or pasting, to provide a liner sub-assembly which can be stored in inventory until required for use. A mirror image liner 26 (shown in position in FIG. 1) can be produced so that two of the liners can be provided on the surface of the inner flexile wall 17.

The liner sub-assembly is shown in FIG. 3 with all of the leaves in place. As shown in FIG. 4, which is the backside of FIG. 3, the bottom strips of material 34 of leaf 31 pass behind the back of the tongue member 29 in spaced, parallel relationship.

Another embodiment of the invention is shown in FIG. 5. In this embodiment, portions of the liner assembly which are visible when the billfold is open are covered with a decorative material which is usually the same as the outside flexible wall 13, i.e. usually leather. A top cover plate 41 is affixed to support member 25 by suitable means such as gluing. A leaf cover plate 43 is affixed to each leaf 31 by suitable means, such as by gluing. The bottom plate 39 is then formed of the same material as the leaf cover plate and the top cover plate.

In a preferred embodiment, assembly tabs are provided on the bottom plate, the top cover plate 41, and the leaf cover plates 43. The bottom cover plate has bottom assembly tab 45, side assembly tab 47, and opposite side assembly tab 49. The leaf cover plate 43 has side assembly tab 51 and opposite side assembly tab 53. The top cover plate 41 has side assembly tab 55, opposite side assembly tab 57, and top assembly tab 59.

In a preferred embodiment of the invention, it is preferred that the liner assembly not be affixed to the inner flexible wall 17 at the edge 61 so that a pocket can be formed between the liner assembly and flexible wall 17. In this embodiment, a pocket wall 37 is interposed between the back of support member 25 and the inner flexible wall 17. Since the side assembly tabs 57, 53, and 49 are not intended, in this embodiment, to be stitched to inner flexible wall 17, these side assembly tabs can be folded around the support member 25 and the sub-assembly liner 37 and stitched in place to provide an integral sub-assembly which has all of the components of the liner stitched firmly together to prevent any movement of one component relative to another. The other edges of the pocket wall 37 are fixed in place during assembly of the billfold by the stitching of the edges.

When it is desired to construct a billfold, one or two of the liner sub-assemblies, a flexible inner wall 17, the fabric 15, and the outside flexible wall 13, are stitched together by folding appropriate assembly tabs and stitching the pieces together in a suitable sequence to provide a billfold, resembling an envelope-like opening along its top side, a plurality of card-receiving cavities and, optionally, one or two flat article receiving pockets extending from edges 61.

The multi-pocket billfold provided by the present invention is economically produced, requires less material for construction, and is labor-saving to manufacture.

What is claimed is:

1. A multi-card liner for use in the assembly of a wallet comprising:

(1) A support member, said support member having at least two vertical slits extending from a bottom edge to provide a downwardly-extending tongue member;

(2) a plurality of leaves, each of said leaves having a tongue-receiving slit extending thereacross;

(3) said leaves being strung along said tongue in a vertically-aligned, partially overlapping array to form an integral liner having a series of single edge overlying cavities arranged in shingled relationship for the reception of cards.

2. A liner in accordance with claim 1 which has a bottom plate generally conforming in shape to a leaf affixed in partially overlapping relationship to the last leaf.

3. A liner in accordance with claim 1 or 2 which has a pocket wall affixed along at least one edge of the back of said liner.

4. A liner in accordance with claim 1 or 2 wherein visible portions of said support member and said leaves are covered with a decorative material.

5. A liner in accordance with claim 2 wherein said support member, said leaves and said bottom plate are provided with assembly tabs.

6. A multi-card billfold having an inner and an outer flexible wall secured together to form an envelope-like opening therein and having at least one of said liners of claim 1 affixed to said inner wall.

7. The multi-card billfold of claim 6 wherein said liner has a bottom plate generally conforming in shape to a leaf affixed in partially overlapping relationship to the leaf.

8. The multi-card billfold of claim 6 wherein said liner has a pocket wall affixed along at least one edge of the back of said liner.

9. The multi-card billfold of claim 6 wherein visible portions of said support member and said leaves of said liner are covered with a decorative material.

10. The multi-card billfold of claim 7 wherein said support member, said leaves and said bottom plate are provided with assembly tabs.

* * * * *